US011784414B2

(12) United States Patent
Goeritz

(10) Patent No.: US 11,784,414 B2
(45) Date of Patent: Oct. 10, 2023

(54) BICONICAL ANTENNA ASSEMBLY

(71) Applicant: Rohde & Schwarz GmbH & Co. KG, Munich (DE)

(72) Inventor: Raimon Goeritz, Munich (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 17/511,803

(22) Filed: Oct. 27, 2021

(65) Prior Publication Data

US 2022/0173517 A1 Jun. 2, 2022

(30) Foreign Application Priority Data

Dec. 2, 2020 (EP) ..... 20211236

(51) Int. Cl.
*H01Q 9/28* (2006.01)
*H01Q 1/08* (2006.01)

(52) U.S. Cl.
CPC ..... *H01Q 9/28* (2013.01); *H01Q 1/085* (2013.01)

(58) Field of Classification Search
CPC ..... H01Q 9/28; H01Q 1/085; H01Q 5/321; H01Q 1/36; H01Q 1/08; H01Q 21/0006; H01Q 21/06; H01Q 23/00
See application file for complete search history.

(56) References Cited

U.S. PATENT DOCUMENTS 2,239,724 A 4/1941 Lindenblad
5,367,312 A * 11/1994 Masters ..... H01Q 9/28 343/807
8,228,257 B2 * 7/2012 Lalezari ..... H01Q 9/28 343/893
8,654,025 B1 2/2014 Brock et al.
8,730,118 B1 * 5/2014 McLean ..... H01Q 9/28 343/773
10,270,292 B2 * 4/2019 Howard ..... H02J 50/23
10,916,855 B1 * 2/2021 Rivera ..... H01Q 21/205
2013/0050040 A1 * 2/2013 Libonati ..... H01Q 9/28 343/773
2015/0145741 A1 * 5/2015 Moulder ..... H01Q 1/525 343/773
2015/0311593 A1 10/2015 Fasenfest
2020/0373676 A1 * 11/2020 Bermeo ..... H01Q 9/28

FOREIGN PATENT DOCUMENTS

CN 106229643 * 12/2016
RU 2221316 C1 1/2004
WO 00/57512 A1 9/2000
WO WO-0057512 A1 * 9/2000 ..... H01Q 9/28

* cited by examiner

*Primary Examiner* — Dameon E Levi
*Assistant Examiner* — Anh N Ho
(74) *Attorney, Agent, or Firm* — CHRISTENSEN O'CONNOR JOHNSON KINDNESS PLLC

(57) ABSTRACT

Embodiments of the present disclosure relate to a biconical antenna assembly for electromagnetic compatibility testing. The biconical antenna assembly has an antenna feeding point, a first antenna structure and a second antenna structure. The first antenna structure and the second antenna structure extend from the antenna feed point towards opposite directions. The biconical antenna assembly includes at least one additional capacitive structure that is attached to a most distal point of the first antenna structure or the second antenna structure from the antenna feed point.

16 Claims, 1 Drawing Sheet

BICONICAL ANTENNA ASSEMBLY

FIELD OF THE DISCLOSURE

Embodiments of the present disclosure relate to a biconical antenna assembly for electromagnetic compatibility (EMC) testing.

BACKGROUND

In the state of the art, biconical antenna assemblies are typically used in electromagnetic interference (EMI) testing such as immunity testing or emissions testing. The biconical antenna assembly corresponds to a broadband antenna assembly that comprises of two roughly conical conductive objects that extend to opposite directions, but nearly touching each other via the ends facing each other. Hence, the biconical antenna assemblies are also called butterfly antenna assemblies due to their appearance. Furthermore, a two-dimensional version of the biconical antenna assembly is called bowtie antenna assembly, which is often used for short-range ultra-high frequency (UHF) television reception.

In general, the biconical antenna assemblies have dipole-like characteristics with a wider bandwidth achieved due to the specific structure, namely the roughly conical conductive objects.

The EMC standards require a frequency range between 20 and 300 MHz to be tested. For testing purposes, the biconical antenna assemblies are connected to an amplifier such that the frequency range between 30 and 300 MHz can be covered appropriately. However, the biconical antenna assemblies known in the state of the art have a bad matching at frequencies in the range of 20 to 30 MHz, resulting in a lower field strength which is disadvantageous for testing purposes. Accordingly, it is necessary to use a more powerful amplifier for testing in order to reach the required field strength in the lower frequency range of 20 to 30 MHz due to the bad matching of the biconical antenna assemblies known in the state of the art.

However, this increases the overall costs for testing, as the powerful amplifier is more expensive.

Accordingly, there is a need for a biconical antenna assembly that can be used with amplifiers at low frequencies in order to ensure EMC testing in an appropriate manner.

SUMMARY

The present disclosure provides examples of a biconical antenna assembly for electromagnetic compatibility (EMC) testing. In an embodiment, the biconical antenna assembly has an antenna feeding point, a first antenna structure and a second antenna structure. The first antenna structure and the second antenna structure extend from the antenna feed point towards opposite directions. The biconical antenna assembly comprises at least one additional capacitive structure that is attached to a most distal point of the first antenna structure or the second antenna structure from the antenna feed point.

The main idea of the disclosure is based on the finding that the biconical antenna assembly has an improved matching compared to the biconical antenna assemblies known in the state of the art due to the additional capacitive structure that is attached to the respective antenna structure. In general, the additional capacitive structure leads to an additional capacity at the point at which the additional capacitive structure is attached to the respective antenna structure, namely the most distal point of the respective antenna structure. In some embodiments, the additional capacitive structure increases the active surface at the distal point of the respective antenna structure.

Due the better matching, a simple amplifier can be used together with the biconical antenna assembly in order to provide the desired field strength at low frequencies, for example in the frequency range of 20 to 30 MHz. In some embodiments, the field strength achieved is improved by 3 dB up to 6 dB.

Accordingly, an EMC test can be conducted while using the biconical antenna assembly according to the present disclosure together with a simple amplifier, wherein the simple amplifier may have a lower output power compared to the ones used previously, for example when testing in the frequency range of 20 to 30 MHz. This is possible due to the improved matching of the biconical antenna assembly which is achieved by the additional capacitive structure located at the most distal point of the respective antenna structure.

The most distal point from the antenna feed point may correspond to the point of the respective antenna structure that has the largest distance to the antenna feed point. According to an embodiment, the most distal point of the respective antenna structure is located on a center axis of the respective antenna structure.

Generally, the antenna structures are electrically conductive.

Moreover, the at least one additional capacitive structure may also be established in an electrically conductive manner, wherein the additional capacitive structure provides an additional capacity to the entire biconical antenna assembly.

Generally, the at least one additional capacitive structure is additional with respect to inherent capacities (capacitances) of components of the biconical antenna assembly, e.g., the ones of the antenna structures. Hence, the at least one additional capacitive structure provides an extra capacity (capacitance) to the biconical antenna assembly.

According to an aspect, the first antenna structure and the second antenna structure each have a substantially conical geometry. In some embodiments, the first antenna structure and the second antenna structure each have a first conical portion and a second conical portion, which are connected with each other via their wide ends. The respective antenna structures ensure that the entire biconical antenna assembly has its biconical shape, for example each of the antenna structures itself is biconically shaped due to the first and second conical portions.

The biconical antenna assembly may be foldable, for example the first and/or second antenna structure. For this functionality, the respective conical portions of the respective antenna structures can be folded accordingly. Thus, the entire biconical antenna assembly can be folded in order to obtain a compact size for transporting.

Another aspect provides that the additional capacitive structure has a galvanic connection to the most distal point of the respective antenna structure. Therefore, the additional capacitive structure is connected with the respective antenna structure in an electrically conductive manner.

Further, the additional capacitive structure may have a three-dimensional geometry. Thus, the additional capacitive structure is different to a disc or rather a plate that may terminate the respective antenna structure. The disc or rather plate may connect several radiating conductors of the respective antenna structure, thereby establishing the respective antenna structure. However, the additional capacitive structure may be attached to the disc or rather plate in a galvanic manner, as the disc or rather plate may be associated to the most distal point of the respective antenna structure.

According to an embodiment, the additional capacitive structure has an ellipsoid shape. The ellipsoid shape ensures that the additional capacitive structure has an electromagnetic effect on the biconical antenna assembly, for example the respective antenna structure to which the additional capacitive structure is attached. Generally, the ellipsoid has three pairwise perpendicular axes of symmetry which intersect at a center of symmetry, called the center of the ellipsoid. The center of the ellipsoid may be located on the center axis of the respective antenna structure to which the additional capacitive structure is connected. The center axis of the respective antenna structure may also run through the center of the antenna feed point.

Another aspect provides that the additional capacitive structure has a substantially spherical shape. Hence, the additional capacitive structure relates to a ball with minor deviations, for instance at a side that is facing the respective antenna structure in order to improve the connection between the additional capacitive structure and the respective antenna structure. For instance, the additional capacitive structure may deviate from the perfectly spherical shape by a flat spot that is used for connecting the additional capacitive structure to the respective antenna structure.

However, the additional capacitive structure may also have a perfectly spherical shape. In this embodiment, the additional capacitive structure may be connected to the respective antenna structure via a coupling element, for example an electrically conductive coupling element, or rather a layer of adhesive, for example an electrically conductive adhesive. The coupling element may relate to the disc or rather place that is part of the respective antenna structure. The coupling element may have a receptacle for the additional capacitive structure, in particular wherein the receptacle has a partly spherical receiving surface for accommodating the additional capacitive structure. A film of adhesive may be provided on the receiving surface such that the additional capacitive structure is adhered to the receptacle. The layer of adhesive may have a certain thickness, thereby ensuring a proper connection of the additional capacitive structure. Generally, a proper mechanical connection is ensured between the additional capacitive structure and the respective antenna structure to which the additional capacitive structure is attached.

According to another aspect, the biconical antenna assembly comprises a first additional capacitive structure and a second additional capacitive structure. The first additional capacitive structure is attached to a most distal point of the first antenna structure from the antenna feed point. The second additional capacitive structure is attached to a most distal point of the second antenna structure from the antenna feed point. Therefore, two additional capacitive structures are provided that are located at the most distal ends of the biconical antenna assembly, for example the respective antenna structures. The additional capacitive structures may be shaped and/or configured in a similar manner such that the biconical antenna assembly is adapted in a symmetric manner concerning its capacitive properties. Generally, the antenna structures each may have a respective center axis, wherein their center axes coincidence with each other. The respective additional capacitive structures each may have a center that is located on the center axes that also run through the center of the antenna feed point. Furthermore, the most distal point of the respective antenna structure may also be located on its respective center axis.

In some embodiments, the biconical antenna assembly is symmetrically shaped, wherein the antenna feed point is located in the center of symmetry. The entire biconical antenna assembly has a symmetric geometry. The symmetry of the biconical antenna assembly may be established by the additional capacitive structures that are located at the most distal points of the respective antenna structures to which the additional capacitive structures are attached.

Another aspect provides that the at least one additional capacitive structure provides improved matching characteristics of the biconical antenna assembly. The additional capacity provided by the additional capacitive structure adapts the matching characteristics of the biconical antenna assembly. Accordingly, the biconical antenna assembly may be connected with an amplifier that can be operated at lower output power compared to the ones used in the state of the art in order to achieve the desired field strength at low frequencies, namely in the frequency range between 20 MHz and 30 MHz.

Further, the antenna structures nearly touch each other at their ends facing the antenna feed point. Put differently, the antenna structures nearly touch each other at those ends that are not assigned to the additional capacitive structure since the additional capacitive structures are attached to the most distal points of the respective antenna structure from the antenna feed point. The antenna structure ends facing each other correspond to those that are located next to the antenna feed point.

According to a certain embodiment, the first antenna structure and/or the second antenna structure are/is established by several radiating conductors. In some embodiments, the several radiating conductors are interconnected with each other at an end facing away from the antenna feed point, namely the most distal point. A light weight and compact design of the entire biconical antenna assembly can be ensured by using several radiating conductors, for example in case the radiating conductors are established by rods. However, the several radiating conductors may also be established by plates Furthermore, the entire biconical antenna assembly may be established in a foldable manner due to the several radiating conductors that can be fold with respect to each other in order to establish a compact transport state of the biconical antenna assembly.

The several radiating conductors of the respective antenna structure may be orientated with respect to each other such that the respective antenna structure has a substantially (bi-)conical geometry. Therefore, the several radiating conductors may run in a non-parallel manner from the antenna feed point towards their free ends. In some embodiments, the several radiating conductors may be inclined with respect to each other, for example inclined to a center axis of the respective antenna structure in the same manner, thereby establishing the conical shape of the respective antenna structure, for example the respective conical portion.

Another aspect provides that the respective antenna structure has an end face at which the most distal point of the respective antenna structure from the antenna feed point is provided. The additional capacitive structure is attached to the most distal point at the end face. In some embodiments, a connecting member is located within the end face, which connects several individual radiating conductors of the respective structure, namely in an electrically conductive manner Hence, the connecting member is part of the respective antenna structure.

The end face of the respective antenna structure may encompass the most distal portion of the antenna structure.

For instance, the end face also encompasses the connecting member via which the several individual radiating conductors are connected with each other in an electrically conductive manner, which together establish the respective antenna structure. The connecting member may correspond to a plate or a disc to which the several individual radiating conductors are electrically connected.

The connecting member may also be used for being connected with the additional capacitive structure in a galvanic manner, as the connecting member, for instance the plate or the disc, provides a connection interface for the additional capacitive structure.

Hence, the additional capacitive structure may extend away from the end face in direction facing away from the antenna feed point. The additional capacitive structure may be attached to the connecting member located within the end face of the respective antenna structure in a galvanic manner Thus, the three-dimensional additional capacitive structure extends away from the respective end face in a direction that is facing away from the antenna feed point.

In other words, the respective additional capacitive structure corresponds to the most distal end of the biconical antenna assembly, as it is connected to the end face of the respective antenna structure, namely the distal point of the respective antenna assembly. Simultaneously, the respective additional capacitive structure extends away from the respective end face of the antenna structure in a direction that faces away from the antenna feed point located in the center of the biconical antenna assembly, for example the center of symmetry.

In general, the additional capacitive structures are attached to the connecting members, for instance by an electrically conductive connecting member such as a screw or rather an electrically conductive adhesive.

BRIEF DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
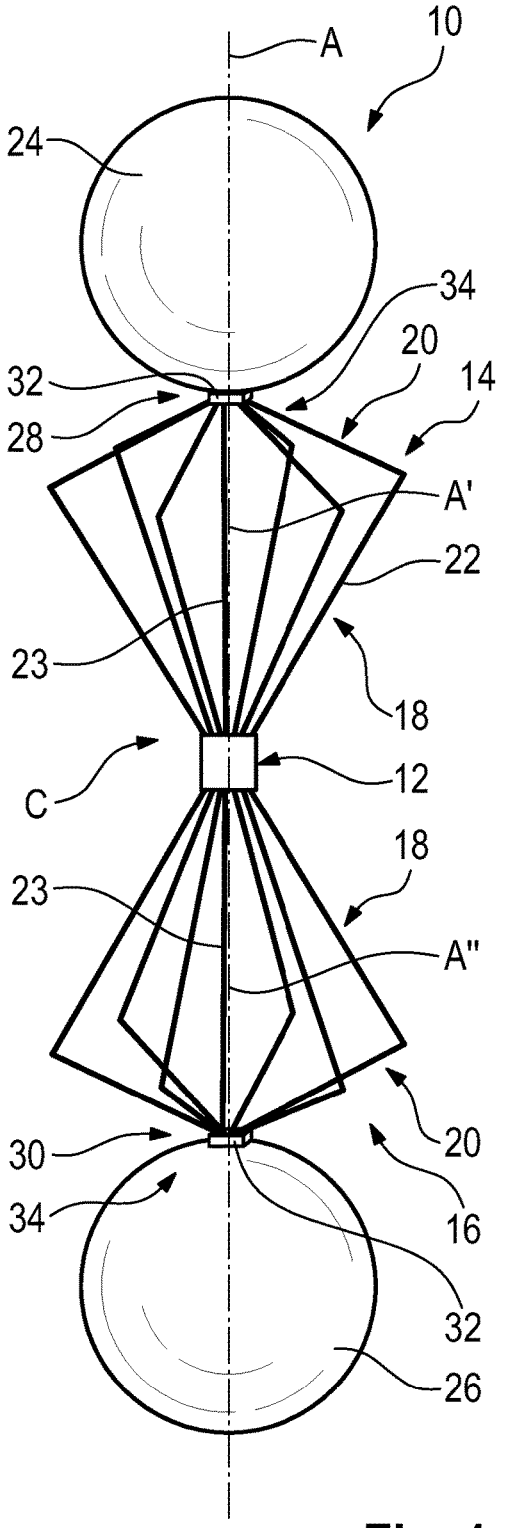
FIG. 1 schematically shows a biconical antenna assembly according to a first embodiment of the present disclosure.

In FIG. 1, a biconical antenna assembly 10 is shown that comprises an antenna feed point 12 located in the center of the biconical antenna assembly 10. The biconical antenna assembly 10 further comprises a first antenna assembly 14 as well as a second antenna assembly 16 which are both extending from the antenna feed point 12 in opposite directions, but nearly touching each other at their ends facing the antenna feed point 12.

In the embodiment shown. the antenna structures 14, 16 each comprise a substantially (bi-)conical geometry, wherein the respective antenna structure 14, 16 has a first conical portion 18 as well as a second conical portion 20. The respective conical portions 18, 20 are connected with each other at their wide ends, as the respective cones of the conical portions 18, 20 are orientated in opposite directions.

As shown in FIG. 1, the respective antenna structures 14, 16 are established by several radiating conductors 22 that are made of electrically conductive rods or bars. The radiating conductors 22 are orientated with respect to each other and with respect to a center axis A of the entire biconical antenna assembly 10 such that the respective antenna structures 14, 16 each have the (bi-)conical geometry. In some embodiments, the center axis A of the entire biconical antenna assembly 10 coincidences with center axes A', A" of the respective antenna structures 14, 16.

The several radiating conductors 22 can be configured such that the biconical antenna assembly 10 can be folded in order to provide a compact transport state. Thus, the several radiating conductors 22 may be moved with respect to a center element 23 that runs along the center axis A', A" of the respective antenna structure 14, 16.

When folding the respective antenna structure 14, 16, the radiating conductors 22 associated with the second conical portion 18 may be moved inwardly towards the antenna feed point 12, wherein the radiating conductors 22 associated with the first conical portion 16 are moved towards the center element 23, thereby ensuring the compact state of the biconical antenna assembly 10.

The biconical antenna assembly 10 may also comprise a first additional capacitive structure 24 as well as a second additional capacitive structure 26. The respective additional capacitive structures 24, 26 are each attached to a most distal point 28, 30 of the respective antenna assemblies 14, 16 to which the respective additional capacitive structure 24, 26 is attached.

In other words, the first additional capacitive structure 24 is attached to the first antenna structure 14 at the most distal point 28 of the first antenna structure 14 from the antenna feed point 12. The second additional capacitive structure 26 is attached to the most distal point 30 of the second antenna structure 18 from the antenna feed point 12.

The respective additional capacitive structures 24, 26 are connected to the respective antenna structures 14, 16 via a galvanic connection. As shown in FIG. 1, the additional capacitive structure 24, 26 generally has a three-dimensional geometry, namely a perfectly spherical shape.

Since both additional capacitive structures 24, 26 are established in a similar manner, the entire biconical antenna assembly 10 is symmetrically shaped, for example wherein the antenna feed point 12 is located in the center of symmetry C of the biconical antenna assembly 10. Hence, the antenna feed point 12 is also located on the center axis A.

The additional capacitive structures 24, 26 provide an improved matching characteristics of the biconical antenna assembly 10 due to the additional capacity provided at the most distal points 28, 30 of the respective antenna structures 14, 16.

Moreover, the respective antenna structures 14, 16 each have a connecting member 32 to which the individual radiating conductors 22 of the respective antenna structures 14, 16 are connected. The connecting member 32 may be established by a disc or rather a plate that can be moved with respect to the center element 23 when folding the biconical antenna assembly 10.

In some embodiments, the connecting member 32 is connected to the several individual radiating conductors 22 in an electrically conductive manner, thereby establishing the respective antenna structure 14, 16. Put differently, the first antenna structure 14 and/or the second antenna structure 16 each comprise the several individual radiating conductors 22 as well as the connecting member 32 to which the individual radiating conductors 22 are electrically connected.

The connecting member 32 is located at an end face 34 of the respective antenna structure 14, 16 at which the most distal point 28, 30 of the respective antenna structure 14, 16 is also provided. In the shown embodiment, the most distal points 28, 30 are also located at the end faces 34 of the respective antenna structures 14, 16.

The additional capacitive structures 24, 26 may be attached to the connecting members 32, for instance by a screw or an electrically conductive adhesive. The screw allows to detach the additional capacitive structures 24, 26, thereby supporting the folding of the biconical antenna assembly 10.

Figure 2:
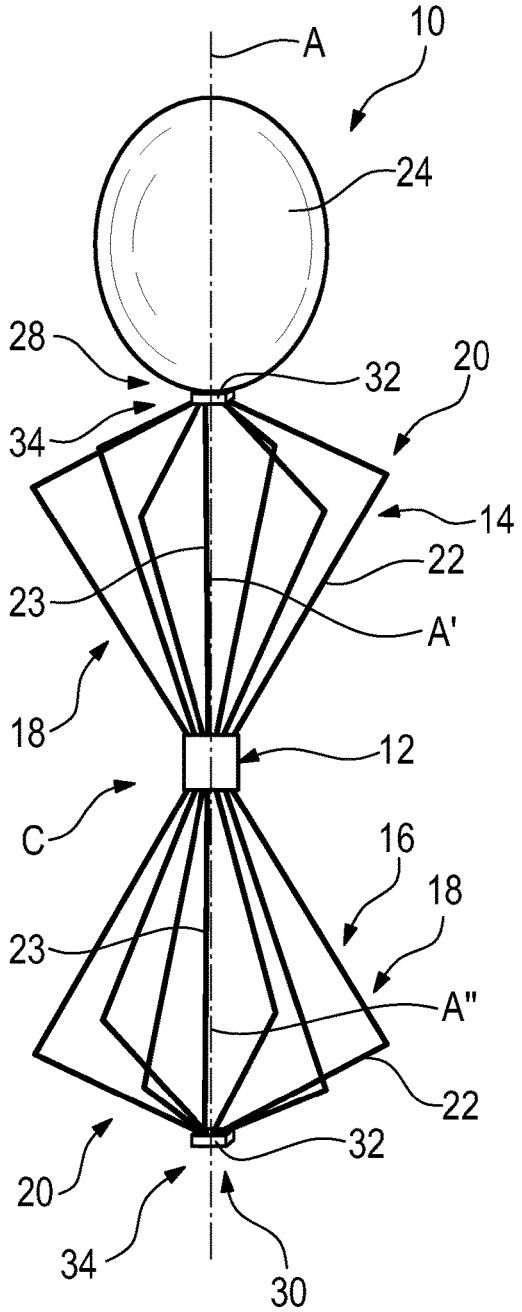
FIG. 2 shows the biconical antenna assembly according to a second embodiment of the present disclosure.

In FIG. 2, an alternative embodiment of the biconical antenna assembly 10 is shown that differs from the one shown in FIG. 1 in that only a single additional capacitive structure 24 is provided such that the entire biconical antenna assembly 10 is not symmetrically shaped.

The additional capacitive structure 24 is however attached to the most distal point 28 of the first antenna structure 14, namely in a similar manner as described above with respect to the embodiment shown in FIG. 1.

In addition, the shape of the additional capacitive structure 24 differs from the perfectly spherical shape of the additional capacitive structures 24, 26 shown in FIG. 1, as the additional capacitive structure 24 shown in FIG. 2 corresponds to an ellipsoid. In some embodiments, the additional capacitive structure 24 has only a substantially spherical shape.

Generally, the additional capacitive structure 24, 26 may have a flat spot that faces the connecting member 32 such that the additional capacitive structure 24, 26 can be connected to the respective connecting member 32 easily, namely via the flat spot, resulting in a deviation from the perfect spherical shape.

In general, the additional capacitive structure 24, 26 provides an additional capacity at the distal ends of the antenna structures 14, 16 thereby improving the matching characteristics of the entire biconical antenna assembly 10. Therefore, the biconical antenna assembly 10 can be operated with a simple amplifier while ensuring the requested field strength at low frequencies, namely within a frequency range of 20 to 30 MHz.

In the foregoing description, specific details are set forth to provide a thorough understanding of representative embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A biconical antenna assembly for electromagnetic compatibility testing, the biconical antenna assembly comprising:

an antenna feed point;

a first antenna structure and a second antenna structure, wherein the first antenna structure and the second antenna structure extend from the antenna feed point towards opposite directions; and at least one capacitive structure that is in addition to inherent capacitances of components of the biconical antenna assembly, wherein the at least one capacitive structure is attached to a most distal point of the first antenna structure or the second antenna structure from the antenna feed point, wherein the at least one capacitive structure has a three-dimensional geometry such that the capacitive structure is different than a disc or a plate that terminates the respective antenna structure, wherein the at least one capacitive structure has an ellipsoid shape or a spherical shape.

2. The biconical antenna assembly according to claim 1, wherein the first antenna structure and the second antenna structure each have a substantially conical geometry.

3. The biconical antenna assembly according to claim 2, wherein the first antenna structure and the second antenna structure each have a first conical portion and a second conical portion which are connected with each other via their wide ends.

4. The biconical antenna assembly according to claim 1, wherein the at least one capacitive structure has a galvanic connection to the most distal point of the respective antenna structure.

5. The biconical antenna assembly according to claim 1, wherein the at least one capacitive structure comprises a first capacitive structure and a second capacitive structure, wherein the first capacitive structure is attached to a most distal point of the first antenna structure from the antenna feed point, and wherein the second capacitive structure is attached to a most distal point of the second antenna structure from the antenna feed point.

6. The biconical antenna assembly according to claim 1, wherein the biconical antenna assembly is symmetrically shaped, and wherein the antenna feed point is located in the center of symmetry.

7. The biconical antenna assembly according to claim 1, wherein the at least one capacitive structure is configured to provide improved matching characteristics of the biconical antenna assembly.

8. The biconical antenna assembly according to claim 1, wherein the first antenna structure and/or the second antenna structure are/is established by several radiating conductors.

9. The biconical antenna assembly according to claim 8, wherein the several radiating conductors are interconnected with each other at an end facing away from the antenna feed point.

10. The biconical antenna assembly according to claim 8, wherein the several radiating conductors of the respective antenna structure are oriented with respect to each other such that the respective antenna structure has a substantially conical geometry.

11. The biconical antenna assembly according to claim 1, wherein the respective antenna structure has an end face at which the most distal point of the respective antenna structure from the antenna feed point is provided, and wherein the at least one capacitive structure is attached to the most distal point at the end face.

12. The biconical antenna assembly according to claim 11, wherein a connecting member is located within the end face, which connects several individual radiating conductors of the respective structure.

13. The biconical antenna assembly according to claim 11, wherein the at least one capacitive structure extends away from the end face in a direction facing away from the antenna feed point.

14. The biconical antenna assembly according to claim 1, wherein matching characteristics of the entire biconical antenna assembly are improved by the at least one capacitive structure such that the biconical antenna assembly is operable within a frequency range of 20 to 30 MHz.

15. A biconical antenna assembly for electromagnetic compatibility testing comprising: an antenna feed point, a first antenna structure and a second antenna structure, wherein the first antenna structure and the second antenna structure extend from the antenna feed point towards opposite directions, and at least one capacitive structure in addition to inherent capacitances of components of the biconical antenna assembly, wherein the at least one capacitive structure is attached to a most distal point of the first antenna structure or the second antenna structure from the antenna feed point, wherein the at least one capacitive structure has an ellipsoid shape, and wherein matching characteristics of the entire biconical antenna assembly are improved by the at least one capacitive structure such that the biconical antenna assembly is operable within a frequency range of 20 to 30 MHz.

16. A biconical antenna assembly for electromagnetic compatibility testing comprising: an antenna feed point, a first antenna structure and a second antenna structure, wherein the first antenna structure and the second antenna structure extend from the antenna feed point towards opposite directions, and at least one capacitive structure that is additional with respect to inherent capacitances of components of the biconical antenna assembly, wherein the at least one capacitive structure is attached to a most distal point of the first antenna structure or the second antenna structure from the antenna feed point, wherein the at least one capacitive structure has a substantially spherical shape or a perfectly spherical shape, and wherein matching characteristics of the entire biconical antenna assembly are improved by the at least one capacitive structure such that the biconical antenna assembly is operable within a frequency range of 20 to 30 MHz.

* * * * *